US011434622B2

(12) United States Patent
Karst

(10) Patent No.: US 11,434,622 B2
(45) Date of Patent: Sep. 6, 2022

(54) HYDRAULIC FLUID TEMPERATURE-DEPENDENT CONTROL OF ENGINE SPEEDS IN SELF-PROPELLED WORK VEHICLES

(71) Applicant: Deere & Company, Moline, IL (US)

(72) Inventor: Austin J. Karst, Bloomfield, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 17/080,991

(22) Filed: Oct. 27, 2020

(65) Prior Publication Data

US 2022/0127822 A1 Apr. 28, 2022

(51) Int. Cl.
*E02F 9/22* (2006.01)

(52) U.S. Cl.
CPC ..... *E02F 9/2246* (2013.01); *E02F 9/226* (2013.01); *E02F 9/2292* (2013.01)

(58) Field of Classification Search
CPC ..... E02F 9/226; E02F 9/2246; E02F 9/2292; F16H 59/72; F15B 2211/6343
See application file for complete search history.

(56) References Cited

U.S. PATENT DOCUMENTS 5,556,349 A * 9/1996 Ishii ..... F16H 59/72 477/76
8,555,843 B2 10/2013 Klousia et al.
8,647,235 B2 2/2014 Thomas et al.
8,899,031 B2 12/2014 Turnis et al.
9,504,212 B2 * 11/2016 Michael ..... A01G 25/16
2008/0254939 A1 * 10/2008 Ichimura ..... F02D 29/04 477/107
2013/0024080 A1 * 1/2013 Robinson ..... B60W 30/1843 701/54
2013/0079194 A1 * 3/2013 Thomas ..... B60W 10/06 477/76
2017/0058922 A1 3/2017 Kenkel et al.

* cited by examiner

*Primary Examiner* — Abiy Teka
(74) *Attorney, Agent, or Firm* — Gary L. Montle; Lucian Wayne Beavers; Patterson Intellectual Property Law, PC

(57) ABSTRACT

Systems and methods are disclosed herein for fluid temperature-dependent control of engine speeds in a self-propelled work vehicle. An engine speed sensor generates signals representing an engine speed, and a temperature sensor generates signals representing a hydraulic fluid temperature. A controller receives the respective signals from the engine speed sensor and the temperature sensor. The controller is further configured, responsive to a startup command, to generate output signals preventing an increase in the engine speed to a target engine speed at least while the temperature of the hydraulic fluid is in a first temperature state. The controller may, e.g., automatically generate output signals for continuous and/or stepwise transitioning of the engine speed to the target engine speed, in accordance with a monitored temperature of the hydraulic fluid and corresponding temperature states.

18 Claims, 13 Drawing Sheets

HYDRAULIC FLUID TEMPERATURE-DEPENDENT CONTROL OF ENGINE SPEEDS IN SELF-PROPELLED WORK VEHICLES

FIELD OF THE DISCLOSURE

The present disclosure relates generally to self-propelled work vehicles, and more particularly to systems and methods for hydraulic fluid temperature-dependent control of engine speeds for such self-propelled work vehicles, for example in the context of cold starting operations.

BACKGROUND

Self-propelled work vehicles as discussed herein may generally refer to tractors or windrowers, but systems and methods as disclosed herein may in certain embodiments relate to other self-propelled work vehicles including, for example, dozers, loaders, excavators, motor graders, etc. Such work vehicles typically comprise a number of hydraulic actuators to perform various functions. Actuators are fluidly connected to a pump on the machine that provides pressurized hydraulic fluid to chambers within the actuators. As the pressurized hydraulic fluid moves into or through the chambers, the pressure of the fluid acts on hydraulic surfaces of the chambers to affect movement of the actuator and in some cases a connected implement (i.e., work tool). When the pressurized fluid is drained from the chambers it is returned to a low pressure tank on the work vehicle.

For machinery that includes a hydraulic system, it is typical practice to warm the fluid prior to valve and/or pump calibration. Also, when operating in particularly cold environments, it is often desirable or necessary to warm up the hydraulic fluid in order to improve hydraulic system performance.

In a commonly implemented hydraulic system, a single load sensing pump (or fixed displacement pump in an open-center valve configuration) is utilized to provide hydraulic flow to all implemented functions on the unit. In such a system, stalling one function raises the system pressure to its relief setting. Actuating a second function causes the pump to move fluid at that relief pressure setting, thus consuming hydraulic power and heating the fluid.

As illustrated in FIG. 1, one or more hydraulic charge pumps 10, 12 are commonly used on self-propelled work vehicles to provide make-up flow for the losses associated in a hydrostatic transmission. The charge pumps 10, 12 may be coupled to an engine (not shown), which can be any known engine such as a diesel or hydraulic engine. As the engine begins to crank during a start, it rotates a pump shaft (not shown) which in turn rotates the first charge pump 10 and second charge pump 12. As both charge pumps rotate, each pump builds a charge pressure and fluid flow through the closed loop hydrostatic transmission system. In some cases the charge system may be implemented as a high pressure charge system in which charge oil is pumped from a reservoir, through an oil cooler 14 and filter 16 before entering the closed loop hydrostatic system.

Elements of the closed loop system coupled to the oil cooler 14 and filter 16 as illustrated in FIG. 1 may include a left ground drive circuit 30 including a pump 32, motor 34, and internal charge relief valve 36. A right ground drive circuit 40 of the closed loop system likewise includes a pump 42, motor 44, and internal charge relief valve 46. A platform circuit 20 of the closed loop system is also part of the illustrated system and includes a pump 22, motor 24, and internal charge relief valve 26. Each relief valve may have a respective pressure threshold, such that the relief valve is closed until the charge pressure exceeds the threshold, but once the charge pressure exceeds the threshold, the relief valve is opened and the oil can flow through the valve. For example, the relief valve can include a spring which has a spring force. To open the relief valve and allow fluid flow there through, the charge pressure must overcome the pressure differential created by the spring force of the relief valve and oil pressure on the opposite side of the valve.

One alternative example of such a high pressure charge system includes an external charge pump rated for pressures up to 3000 pounds per square inch (psi). Another example being implemented on conventional self-propelled windrowers includes the use of internal gerotor pumps with rated pressures up to 600 psi. Conventional hydraulic systems may further include the ability to monitor the hydraulic oil temperature using one or more temperature sensors.

During a cold start condition, where for example the temperatures may drop to below 0° C., inherent restrictions in the system can cause the charge pressure to exceed pressures higher than the rated capabilities of the oil cooler. In this case a bypass valve 18 may be used to bypass the oil cooler 14 and filter 16 for system protection. A solenoid may be electrically coupled to a controller such that control signals from the controller energize the solenoid to control the bypass valve 18.

Referring next to FIGS. 2 and 3, one problem with the current designs is that the bypass valve 18 spring setting has to be very low to allow for cold starts without damaging the internal charge pump(s) 10, 12 with a much lower pressure rating than an external gear type pump. However, a lower bypass setting results in more operating states in which unfiltered bypass oil may reach the hydrostatic transmission.

FIG. 2 illustrates the results of an exemplary charge pressure design study at 0° C., wherein it is apparent that the maximum continuous rating for the pump pressure is exceeded when using a 300 psi bypass valve 18, even at low idle operating modes, and is significantly exceeded for higher operating modes (mid- or high idle states). Reducing the bypass spring setting to, e.g., 150 psi value results in more acceptable pressure levels but also allows for more unfiltered oil entering the system at different conditions.

FIG. 3 illustrates the results of an exemplary charge pressure study using reduced bypass settings at various oil temperatures. Generally stated, it is preferred to minimize the amount of flow across the bypass valve 18 to prevent contamination in the charge system. As shown in the first portion of the diagram, almost all low-idle conditions result in oil going to the filter 16. As shown in the second portion of the diagram, the bypass flow at mid-idle operation is unacceptable at 0° C. and above the preferred target maximum even at 10° C. As further shown in the third portion of the diagram, the oil temperature must be at 20° C. or greater to provide acceptable bypass flow at high-idle operations.

FIG. 4 further illustrates the results of an exemplary charge pump pressure study with reduced bypass settings, at various operating states and oil temperatures. It will be apparent from the illustrated results that the pump pressures are below the maximum acceptable pump pressure (e.g., at about 500 psi) at all temperatures in a low-idle operating state. However, the oil temperature must be at least 10° C. to provide acceptable pump pressure at mid-idle operating states, and the oil temperature must further be at least 20° C. to provide acceptable pump pressure at high-idle operating states.

BRIEF SUMMARY

The current disclosure provides an enhancement to conventional systems, in certain embodiments including a reduction in the bypass valve setting as well as a reduction in bypass flow over different operating conditions. Other potential enhancements, dependent in part on the type of vehicle, hydrostatic system, and other design features include an ability to incorporate internal charge pumps into a high pressure cooling system, improved life of the charge pump and hydraulic system, a reduction in unfiltered bypass oil and contamination into the closed loop hydrostatic system, utilization of temperature sensors for system protection, an automated hydraulic oil warm up process, and further benefits as may become apparent to one of skill in the art in view of the disclosure provided herein.

Various embodiments of such enhancements as disclosed herein may desirably enable reduction of the charge pump pressure and bypass flow by restricting or varying the engine speed to obtain acceptable operating conditions that will not damage the hydraulic system.

In one exemplary embodiment, a method as disclosed herein is provided for engine speed control for a self-propelled work vehicle comprising an engine, a hydraulic motor, and one or more hydraulic pumps. The method includes detecting an engine speed and a temperature of hydraulic fluid. Responsive to a requested change in engine speed (e.g., as may occur with a startup command or an equivalent), an increase in the engine speed to the target engine speed is prevented at least while the temperature of the hydraulic fluid is in a first temperature state.

In one exemplary aspect according to the above-reference embodiment, user input corresponding to a target engine speed may be provided, via for example a user interface. Alternatively, the target engine speed may be predetermined and/or automatically retrievable from data storage, e.g., in autonomous startup applications.

In one exemplary aspect according to the above-referenced embodiment and related aspects, information may be displayed to the user corresponding to an appropriate temperature state for the target engine speed.

In another exemplary aspect according to the above-referenced embodiment and related aspects, the engine speed may be automatically transitioned to the target engine speed, based on a monitored temperature of the hydraulic fluid and one or more corresponding temperature states.

In another exemplary aspect according to the above-referenced embodiment and related aspects, the transitioning of the engine speed to the target engine speed is accomplished in steps as the monitored temperature exceeds respective thresholds for the one or more corresponding temperature states.

In another exemplary aspect according to the above-referenced embodiment and related aspects, the first temperature state corresponds to a first engine speed for temperatures below a first temperature threshold (e.g., 10° C.).

In another exemplary aspect according to the above-referenced embodiment and related aspects, a second temperature state corresponds to a second engine speed for temperatures below a second temperature threshold (e.g., 15° C.) and above the first temperature threshold.

In another exemplary aspect according to the above-referenced embodiment and related aspects, a third temperature state corresponds to the target engine speed.

In another exemplary aspect according to the above-referenced embodiment and related aspects, the second temperature state corresponds to the second engine speed for temperatures below 20 degrees Celsius.

In another exemplary aspect according to the above-referenced embodiment and related aspects, the engine speed is continuously transitioned to the target engine speed, based on a determined relationship between the engine speed and a monitored temperature of the hydraulic fluid.

In another embodiment as disclosed herein, a control system is provided for a self-propelled work vehicle comprising an engine speed sensor configured to generate signals representing an engine speed, a hydraulic motor, one or more hydraulic pumps, and a temperature sensor configured to generate signals representing a temperature of hydraulic fluid. The control system includes a controller functionally linked to receive the respective signals from the engine speed sensor and the temperature sensor, and the controller may be configured to direct the performance of a method according to the above-referenced embodiment and any of the exemplary aspects in associated therewith.

In one exemplary aspect according to the aforementioned embodiment of the control system, a data storage unit may be functionally linked to the controller, the data storage unit comprising a look-up table correlating retrievable engine speed data with inputs for the monitored temperature of the hydraulic fluid.

Numerous objects, features and advantages of the embodiments set forth herein will be readily apparent to those skilled in the art upon reading of the following disclosure when taken in conjunction with the accompanying drawings.

DETAILED DESCRIPTION

Referring now to FIGS. 5-14, various embodiments may now be described of a system and method for engine speed control with hydraulic oil temperature dependency. The embodiments of the present invention described below are not intended to be exhaustive or to limit the invention to the precise forms disclosed in the following detailed description. Rather, the embodiments are chosen and described so that others skilled in the art may appreciate and understand the principles and practices of an invention as disclosed herein.

Figure 1:
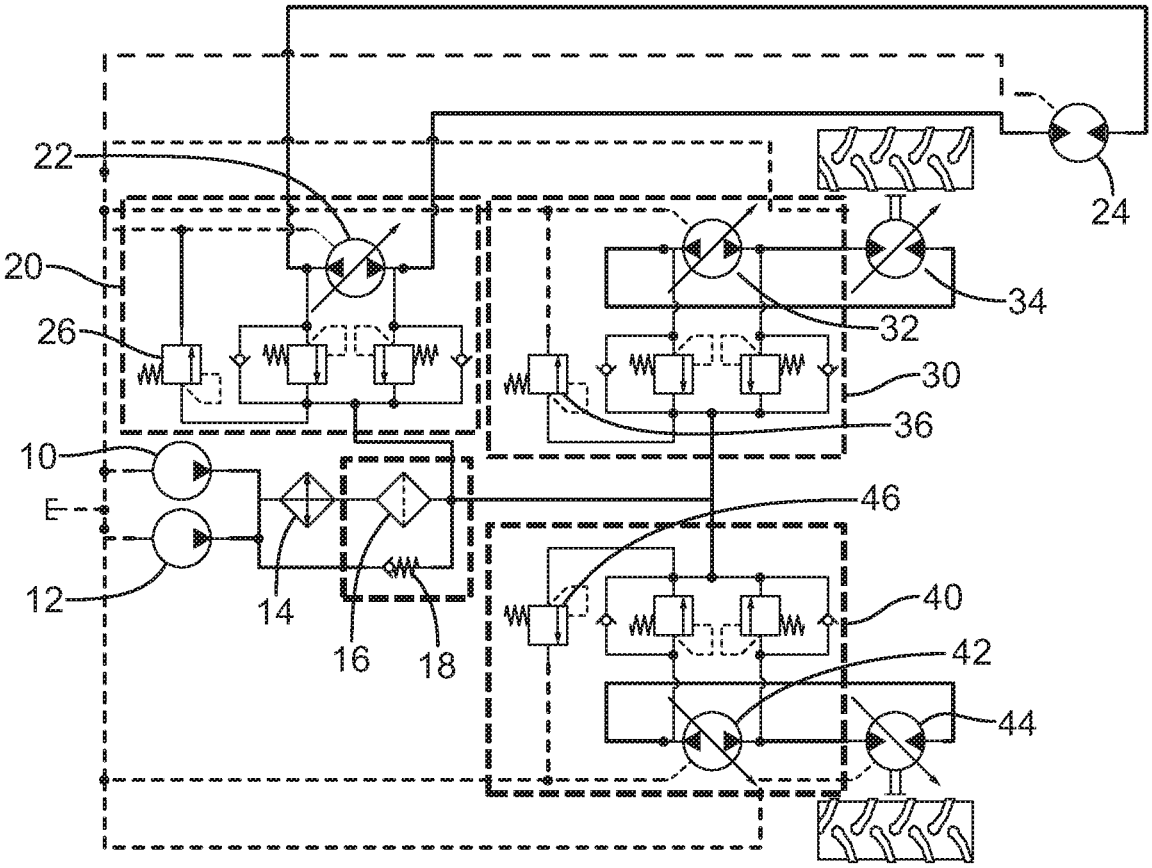
Fig. 1 (PRIOR ART)
FIG. 1 is a graphical diagram representing a closed loop hydrostatic system as conventionally known in the art.
Figure 2:
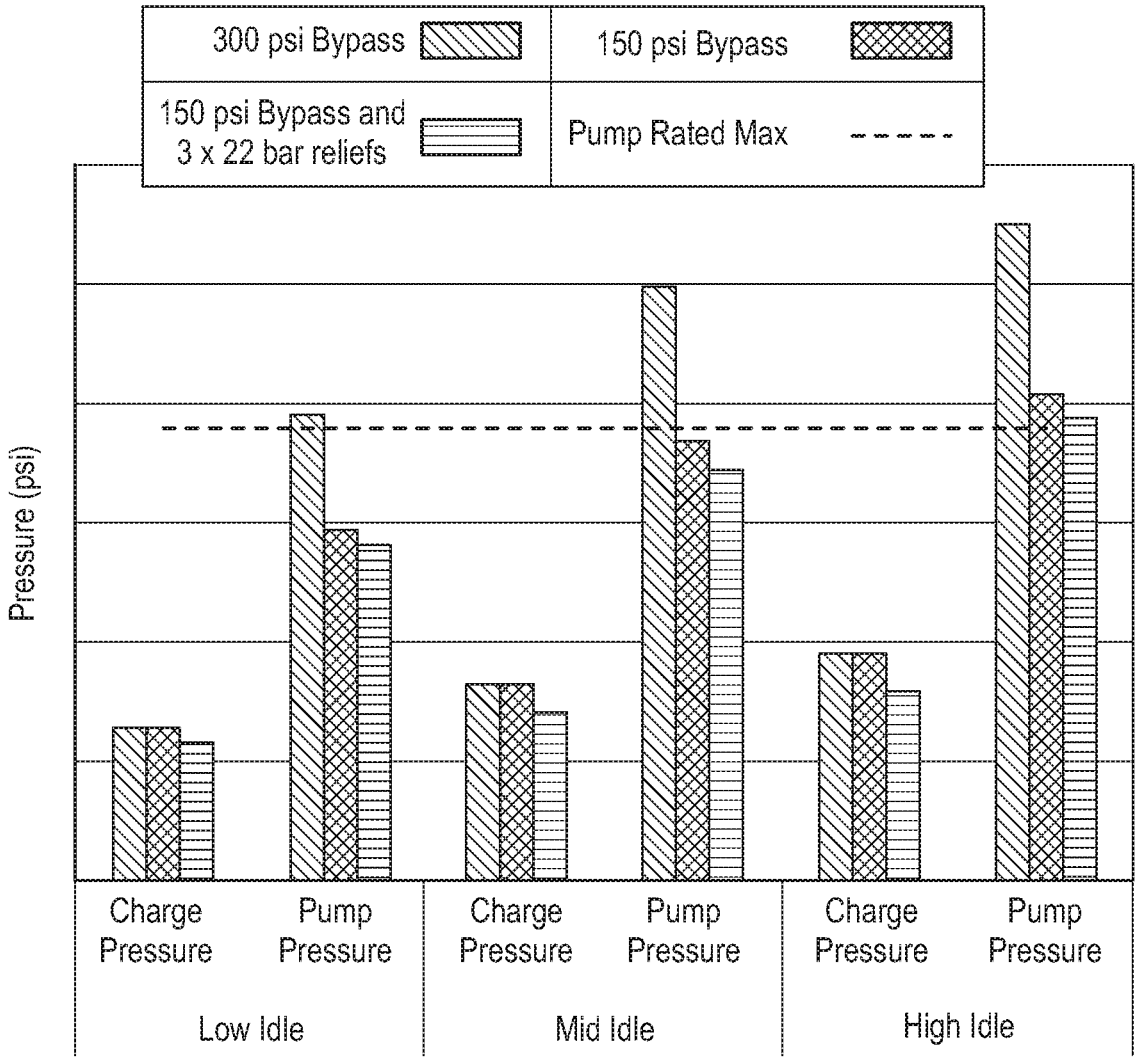
Fig. 2 (PRIOR ART)
FIG. 2 is a graphical diagram representing various bypass settings in an exemplary charge pressure design study at 0° C.
Figure 3:
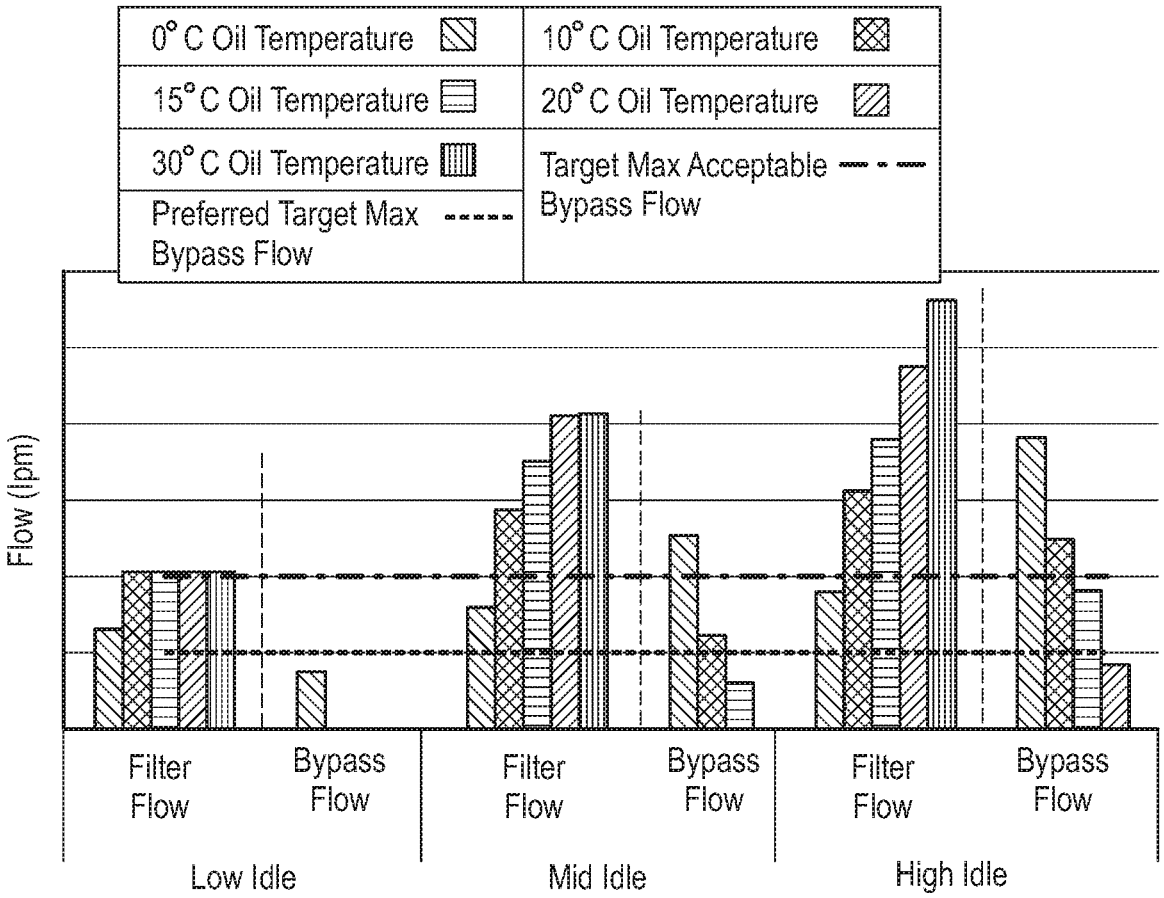
FIG. 3 is a graphical diagram representing charge pressure filter and bypass flow with reduced bypass settings, at various oil temperatures.
Figure 4:
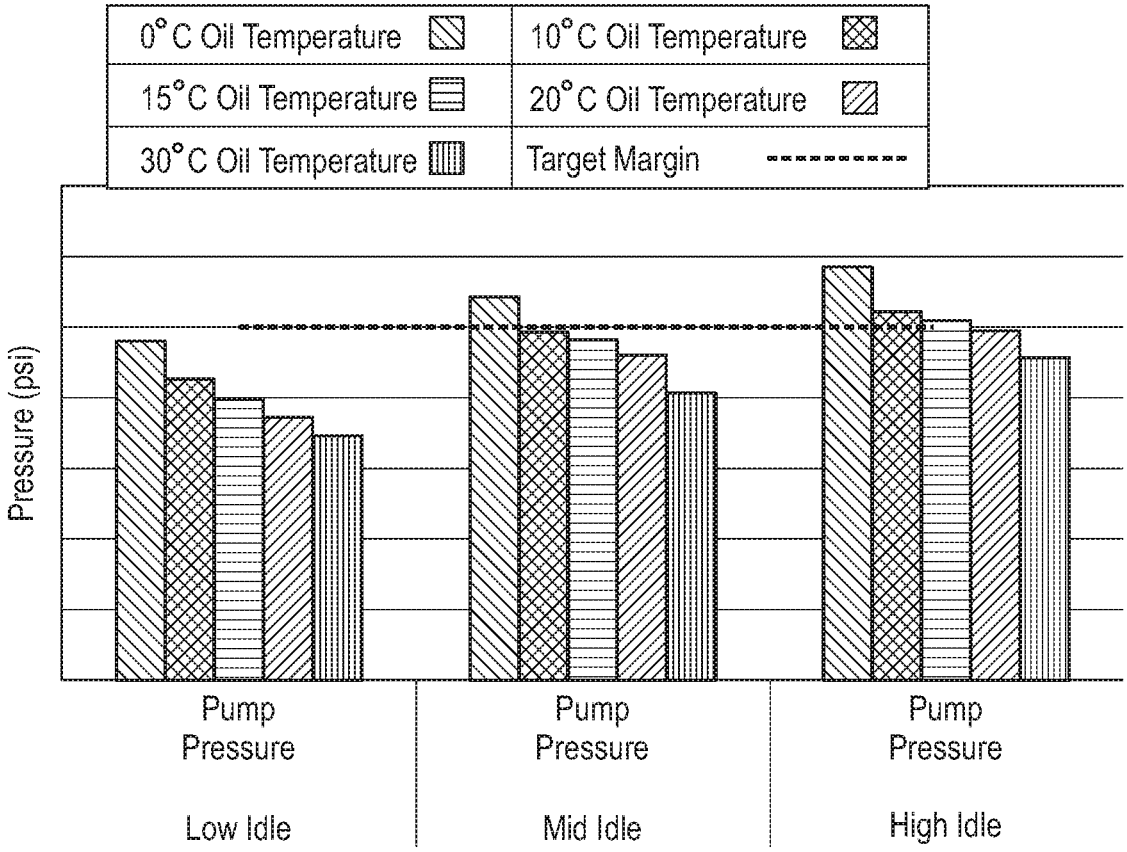
FIG. 4 is a graphical diagram representing an exemplary relationship between engine speed, hydraulic oil temperature, and pump pressure.
Figure 5:
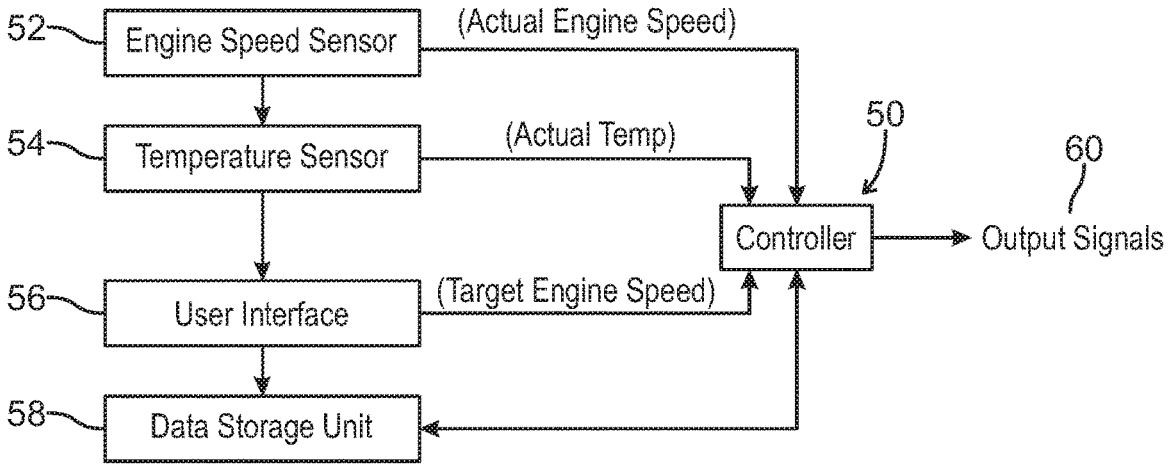
FIG. 5 is a block diagram representing an embodiment of a control system as disclosed herein.

FIG. 5 in a particular embodiment as disclosed herein shows a representative engine speed control system including an engine speed sensor 52 configured to produce output signals representative of an actual engine speed and a temperature sensor 54 configured to produce output signals representative of an actual hydraulic fluid (oil) temperature.

The engine speed sensor 52 may be any of a number of conventionally known engine speed sensors, and may for example be positioned near or on the crankshaft of the engine.

The hydraulic oil temperature sensor 54 may be any of a number of conventionally known fluid sensors as capable of for example measuring the oil temperature in the hydrostatic transmission system and generating output signals representative thereof to the controller 50.

A user interface 56 may be provided for example in an operator's station or other equivalent and accessible locations on the self-propelled work vehicle. The term "user interface" 56 as used herein may broadly take the form of a display unit and/or other outputs from the system such as indicator lights, audible alerts, and the like. The user interface may further or alternatively include various controls or user inputs (e.g., a steering wheel, joysticks, levers, buttons) for operating the self-propelled work vehicle, including operation of the engine, hydraulic cylinders, and the like. Such an onboard user interface may be coupled to a vehicle control system via for example a CAN bus arrangement or other equivalent forms of electrical and/or electro-mechanical signal transmission. Another form of user interface (not shown) may take the form of a display that is generated on a remote (i.e., not onboard) computing device, which may display outputs such as status indications and/or otherwise enable user interaction such as the providing of inputs to the system. In the context of a remote user interface, data transmission between for example the vehicle control system and the user interface may take the form of a wireless communications system and associated components as are conventionally known in the art.

The controller 50 receives as inputs the output signals from the engine speed sensor 52 and the temperature sensor 54, and may be part of the machine control system of the working machine, or it may be a separate control module. Accordingly, the controller 50 may generate output signals 59 for controlling the operation of various actuators throughout the self-propelled work vehicle, which may for example include various electro-hydraulic control valves associated with respective actuators, wherein the electro-hydraulic control valves control the flow of hydraulic fluid to and from the respective hydraulic actuators to control the actuation thereof in response to the control signal from the controller 50. The controller 50 may include or be functionally linked to the user interface 56, for example to generate text, data and/or other indicia for display on an associated display unit, and/or to receive user inputs from the user interface 56, and the controller 50 may optionally be mounted in the operator's station at a control panel.

A controller 240 in an embodiment may include or may be associated with a processor, a computer readable medium, a communication unit, data storage 58 such as for example a database network, and the aforementioned user interface 56 or control panel having a display. The data storage 58 may include look-up tables as further described herein in a selectively retrievable format with respect to the controller 50. An input/output device, such as a keyboard, joystick or other user interface tool, may be provided so that the human operator may input instructions to the controller 50. It is understood that the controller described herein may be a single controller having all of the described functionality, or it may include multiple controllers wherein the described functionality is distributed among the multiple controllers.

Various operations, steps or algorithms as described herein can be embodied directly in hardware, in a computer program product such as a software module executed by a processor, or in a combination of the two. The computer program product can reside in RAM memory, flash memory, ROM memory, EPROM memory, EEPROM memory, registers, hard disk, a removable disk, or any other form of computer-readable medium known in the art. An exemplary computer-readable medium can be coupled to the processor such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

A communication unit may support or provide communications between the controller 50 and external systems or devices, and/or support or provide a communication interface with respect to the sensing elements and other internal components of the self-propelled work vehicle. The communications unit may include wireless communication system components (e.g., via cellular modem, WiFi, Bluetooth or the like) and/or may include one or more wired communications terminals such as universal serial bus ports.

Figure 6:
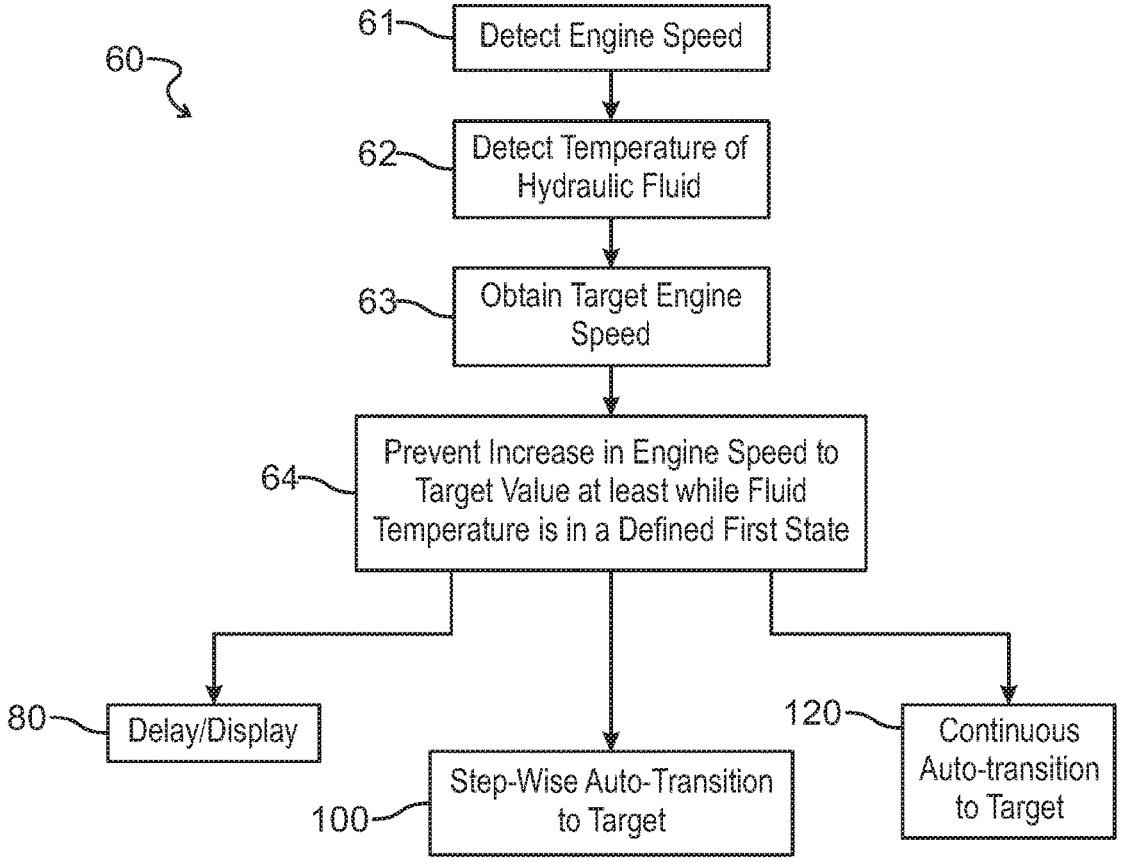
FIG. 6 is a flowchart representing a method as disclosed herein.

An exemplary embodiment of a method 60 for engine speed control may next be described generally, with illustrative reference to FIG. 6. Various and more particular embodiments of the method will further be described by reference to FIGS. 7-14.

As previously noted, there are hydraulic oil temperatures at different engine idle conditions that result in acceptable pump pressures below the maximum rating. In view of these relationships, the method 60 includes steps of detecting an actual engine speed (step 61 in FIG. 6), detecting an actual hydraulic oil temperature (step 62), and obtaining a target engine speed (step 63), for example as a user input command via the user interface 56. It may be understood that in certain applications, such as for example in autonomous vehicle operation, the target engine speed may be predetermined or otherwise automatically provided (retrievable from data storage) in response to a requested change in engine speed such as may occur with a startup command or an equivalent thereof.

In step 64, the controller 50 is configured to prevent a premature increase of the actual engine speed to a commanded (target) engine speed, at least when the hydraulic oil temperature is determined to be in a defined first state. The first oil hydraulic oil temperature state may vary according to different work vehicles and work applications, but typically correlates to safe operation at the current (e.g., low-idle) engine speed and unsafe operation at higher (e.g., mid-idle and high-idle) engine speeds. An equivalent operation by the controller 50 may be conducted after the engine speed has safely increased to, e.g., mid-idle speeds, if a further commanded engine speed is received by the controller but it is determined that the hydraulic oil temperature is in a defined second state. As with the first hydraulic oil temperature state, the second oil hydraulic oil temperature state may vary according to different work vehicles and work applications, but typically correlates to safe operation at the current (e.g., mid-idle) engine speed and unsafe operation at higher (e.g., high-idle) engine speeds. One of skill in the art may appreciate that additional hydraulic oil temperature states and corresponding engine speed thresholds may be provided where applicable.

Figure 7:
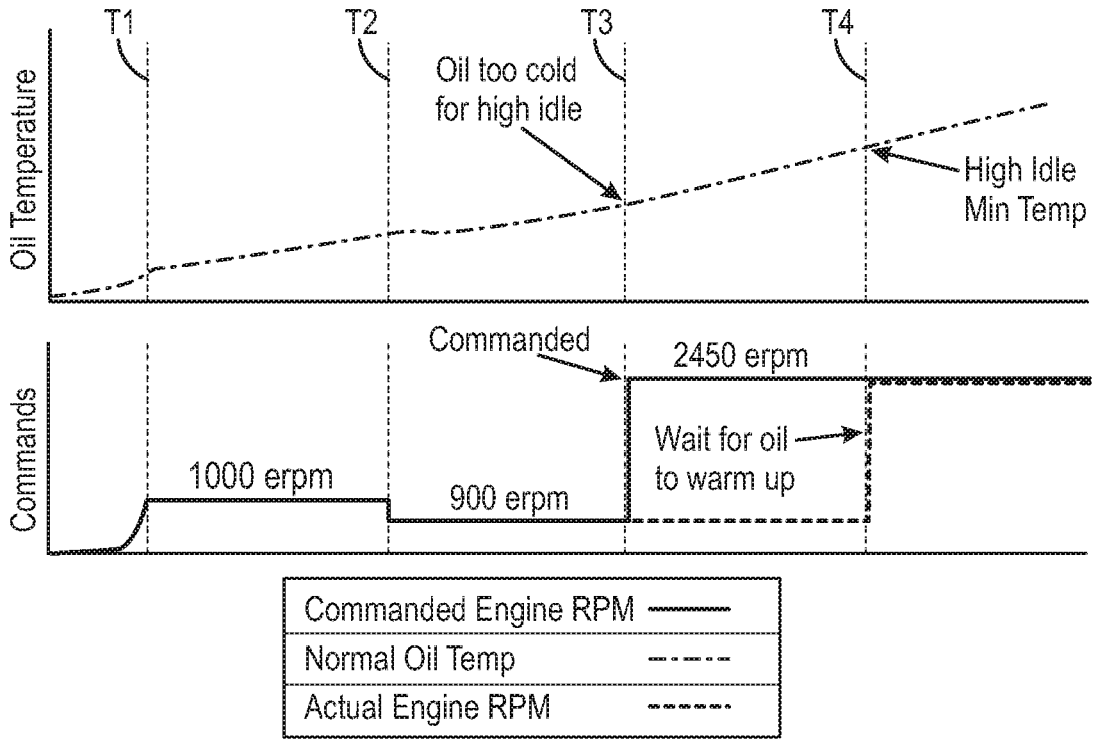
FIG. 7 is a graphical diagram representing an exemplary cold start operation, wherein engine speed progression is delayed until the oil temperature is sufficiently warmed up.
Figure 8:
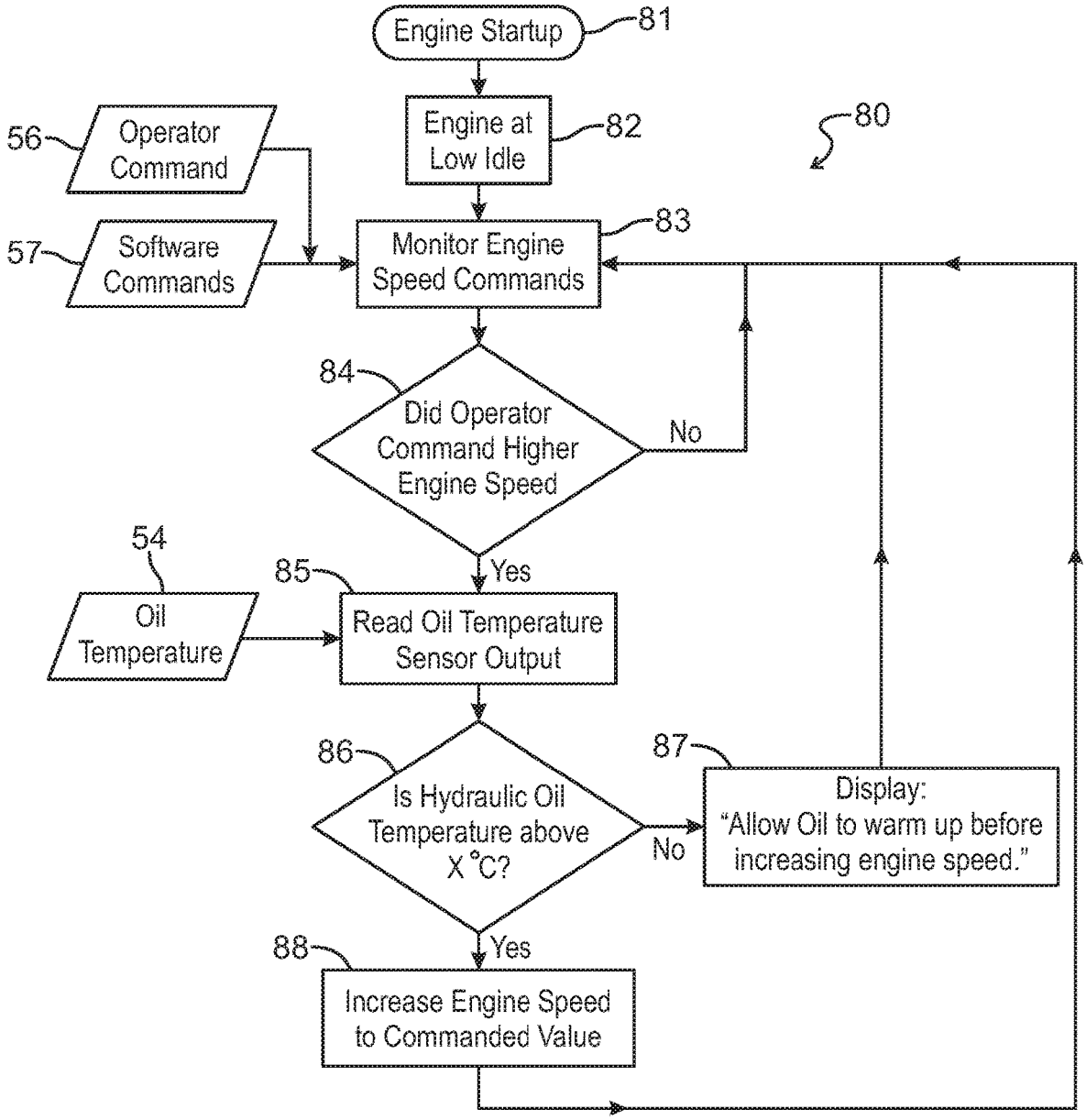
FIG. 8 is a flowchart representing an exemplary embodiment of the method wherein the operator is informed when the oil temperature is sufficient for engine speed progression.

Referring next to FIGS. 7 and 8, an embodiment of a method 80 generally corresponding to the aforementioned method 60 may next be described, wherein the engine speed is limited to low idle for temperatures below a given threshold. In this case, an operator may choose to go to high idle when the oil is at 0° C. which may cause significant damage to the pump. The vehicle software will ignore this request and report to the operator that they should allow the oil to warm up while the engine is at low idle, and the operator may retry the command once the system has properly warmed up.

The method 80 begins with engine startup (step 81) for generating power to the self-propelled work vehicle, wherein the engine speed ramps up (step 82) to a low-idle state (i.e., 1000 erpm) at time T1. The controller may determine that engine startup has initiated based upon the detected engine speed exceeding a startup threshold (e.g., 300 erpm), which may vary in accordance with the type of engine or other startup conditions.

As the engine speed is maintained at this first state throughout the duration T1-T2, and then is adjusted at time T2 to 900 erpm, the hydraulic oil temperature continues to warm up.

Operator-provided engine speed commands 56 and/or software commands 57 are monitored (step 83). If an operator command or an equivalent programmatic command for a higher engine speed is determined (step 84), the actual hydraulic oil temperature is calculated or otherwise obtained (step 85) via the hydraulic oil temperature sensor 54. In the illustrated example of FIG. 7, an operator command or an equivalent programmatic command is received at time T3 to increase the engine speed to 2450 erpm. However, it is determined at that time that the hydraulic oil temperature remains too cold for a high-idle operating state, or in other words is not above a minimum temperature threshold (step 86), and therefore the actual engine speed remains at 900 erpm.

A message is accordingly displayed to the operator via the user interface 56, such as "Allow oil to warm up before increasing engine speed" (step 87), wherein the method returns to step 83 and continues monitoring operator commands for another commanded increase in the engine speed.

In an exemplary variation, the method 80 may provide varying messages to the operator, dependent on the measured hydraulic oil temperature and the commanded engine speed. For example, if the engine speed is currently at low-idle and the operator submits a high-idle command, while the hydraulic oil temperature is not suitable for high-idle operation but may be suitable for mid-idle operation, the controller may be configured to generate a display a recommendation for an appropriate engine speed corresponding to the mid-idle state (e.g., 1800 erpm).

As another example, rather than merely advising the operator to allow the oil to warm up before increasing engine speed, the display may convey more specific oil temperature thresholds as needed before proceeding to the next engine speed level. In varying contexts, the display may for example read "Allow oil to warm up to 20° C. before requesting high idle" or "Allow oil to warm up to 10° C. before requesting mid idle".

At a point T4 afterwards, the command is repeated and this time the detected hydraulic oil temperature has exceeded the threshold (e.g., 20° C.), wherein the method proceeds to step 88 and increases the actual engine speed to the commanded value of 2450 erpm.

Figure 9:
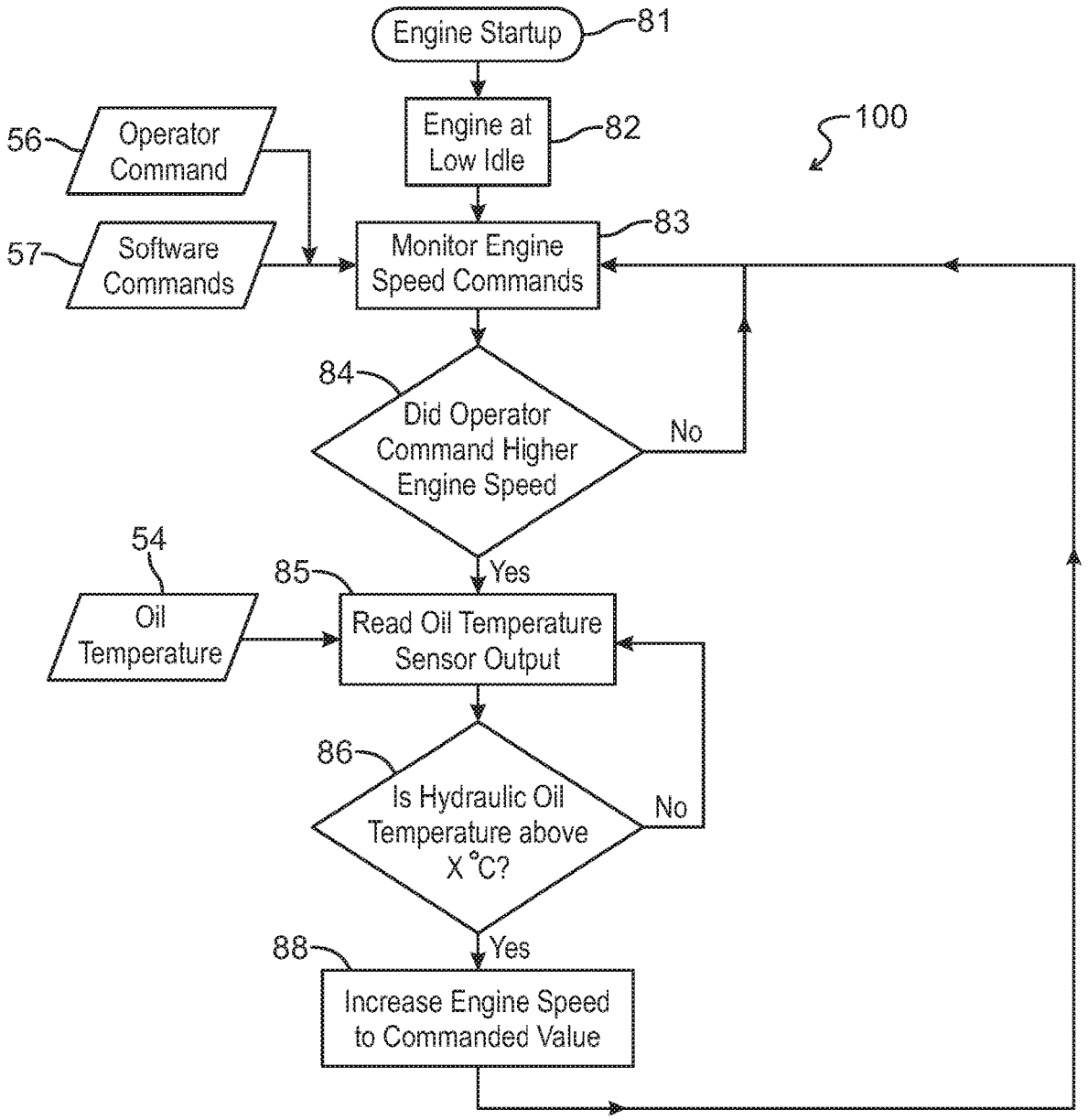
FIG. 9 is a flowchart representing an exemplary embodiment of the method comprising automated engine speed adjustment.

Referring next to FIG. 9, another embodiment of a method 100 generally corresponding to the aforementioned method 60 may next be described. This embodiment 100 shares many steps with the immediately preceding embodiment 80, but differs in that engine speed control is automatically implemented in accordance with appropriate delays to allow for safe operating conditions.

The method 100 begins with engine startup (step 81), wherein the engine speed ramps up (step 82) to a low-idle state (i.e., 1000 erpm) at time T1. As the engine speed is maintained at this first state throughout the duration T1-T2, and then is adjusted at time T2 to 900 erpm, the hydraulic oil temperature continues to warm up.

Operator-provided engine speed commands 56 and software commands 57 are continuously or at least periodically monitored (step 83). If an operator command for a higher engine speed is determined (step 84), the actual hydraulic oil temperature is calculated or otherwise obtained (step 85) via the hydraulic oil temperature sensor 54. In the illustrated example of FIG. 7, an operator command is received at time T3 to increase the engine speed to 2450 erpm. However, it is determined at that time that the hydraulic oil temperature remains too cold for a high-idle operating state, or in other words is not above a minimum temperature threshold (step 86), and therefore the actual engine speed remains at 900 erpm.

The controller 50 continues to monitor the hydraulic oil temperature, and at a point T4 the controller 50 automatically determines that the detected hydraulic oil temperature has exceeded the threshold (e.g., 20° C.), wherein the method proceeds to step 88 and increases the actual engine speed to the commanded value of 2450 erpm.

Figure 10:
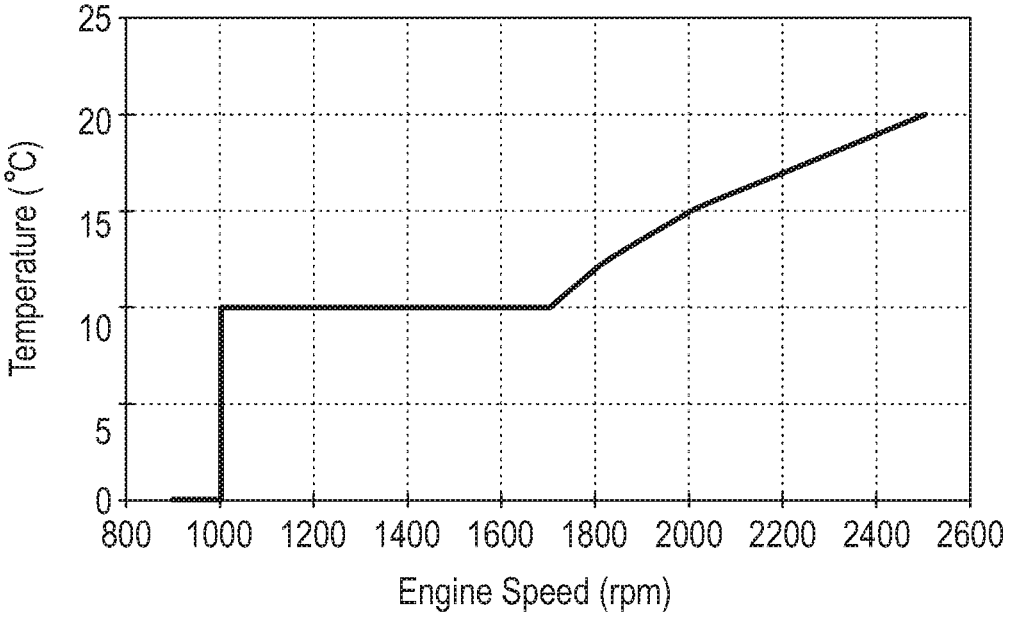
FIG. 10 is a graphical diagram representing an exemplary engine speed and hydraulic oil temperature look-up table.
Figure 11:
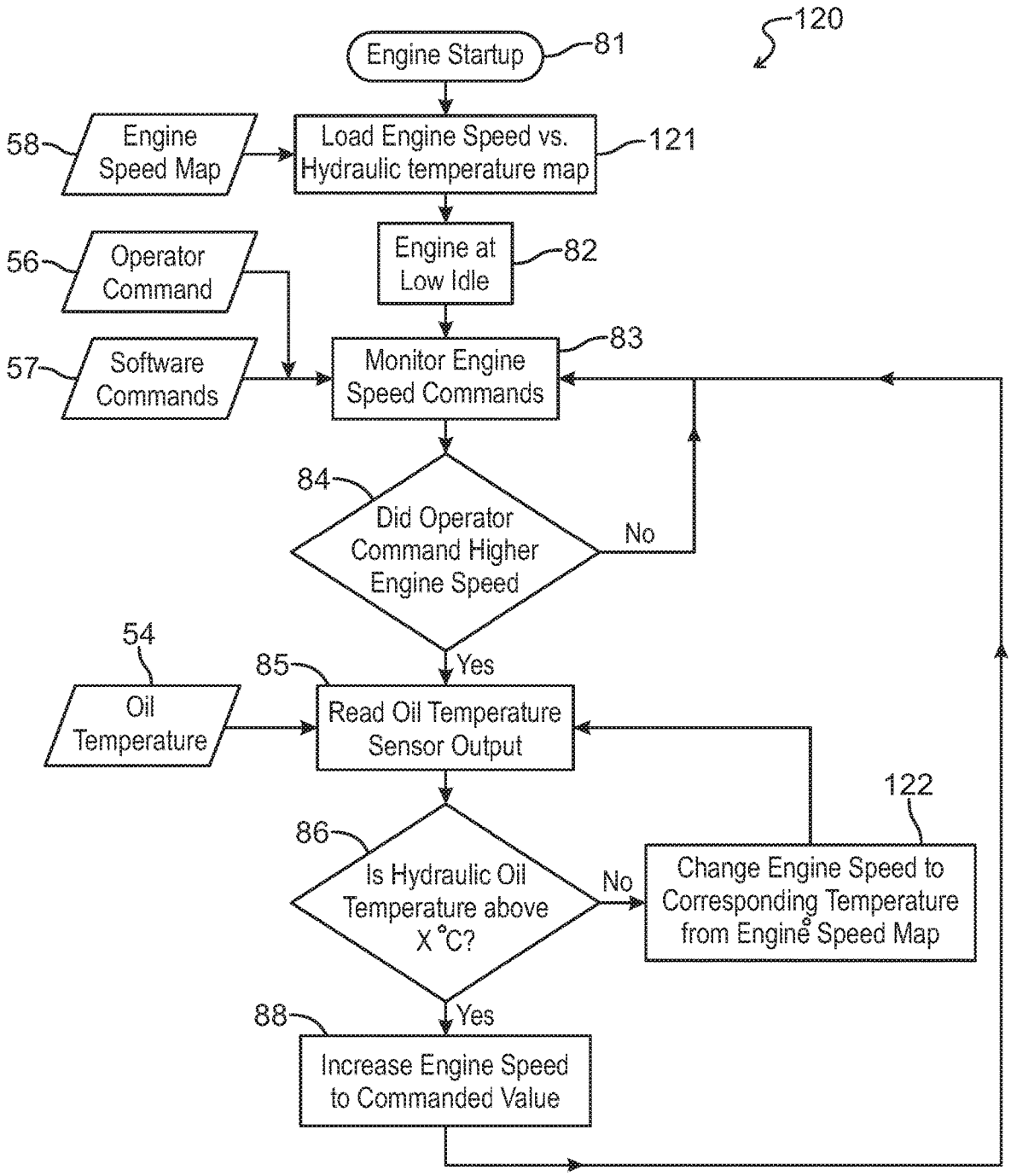
FIG. 11 is a flowchart representing an exemplary embodiment of the method comprising automated engine speed adjustment implementing the look-up table in FIG. 10.
Figure 12:
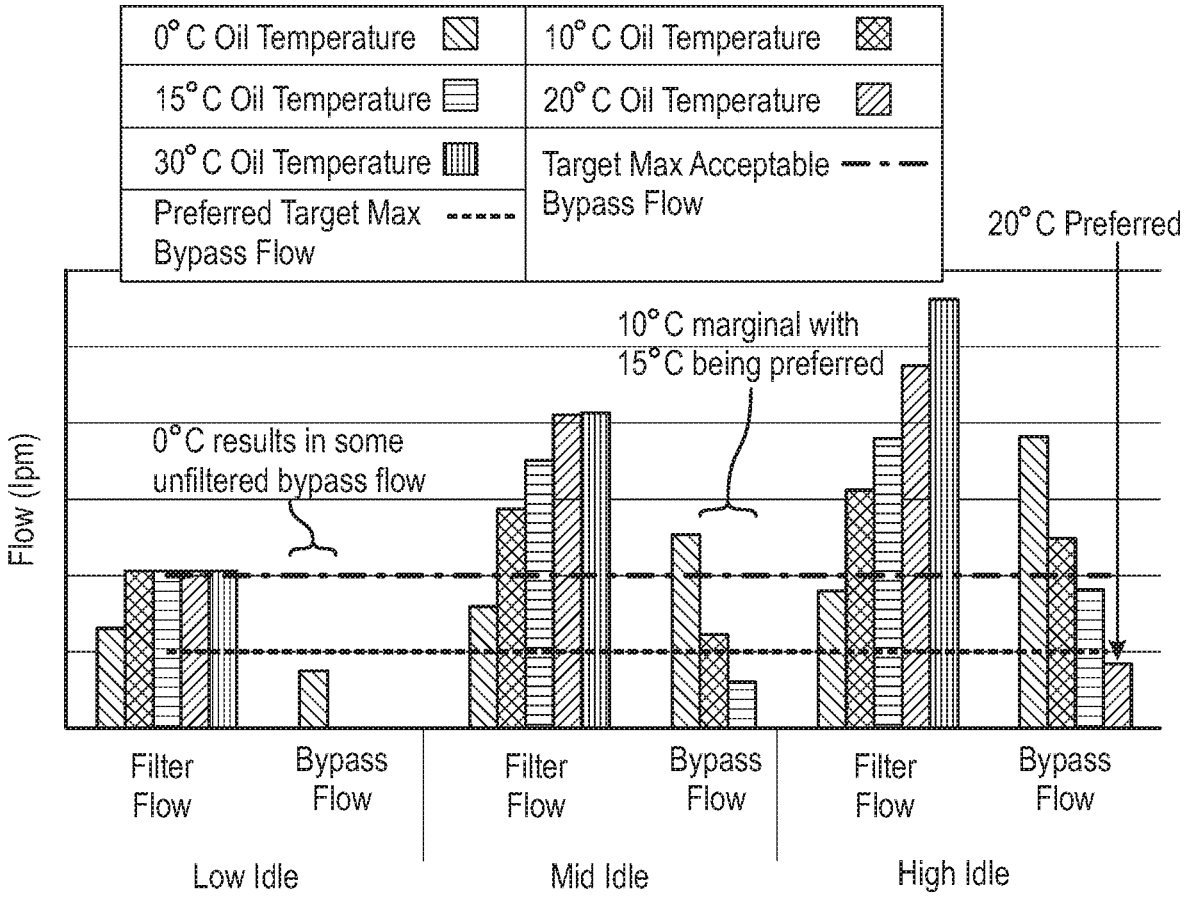
FIG. 12 is a graphical diagram representing charge pressure filter and bypass flow with reduced bypass settings, at various oil temperatures, in an exemplary model for developing the look-up table in FIG. 10.

Referring next to FIGS. 10 and 11, another embodiment of a method 120 generally corresponding to the aforementioned method 60 may next be described, in which the engine speed automatically ramps up to the operator's commanded engine speed based on a predetermined relationship between the engine speed and the hydraulic oil temperature. This method 120 provides the added improvement wherein the increase in engine speed will also aid in warming up the oil while minimizing the bypass oil so that the operator does not have to wait as long to operate normally. This embodiment 120 shares many steps with the immediately preceding embodiments 80, 100, but differs in that engine speed control and hydraulic oil temperature are correlated via a data map/look-up table (represented in FIG. 10) that is retrievably stored in the data storage unit 58 and linked to the controller 50.

In alternative embodiments, the look-up table may be stored remotely, for example in a cloud server accessible by the controller via a communications network, and loaded into the controller upon engine startup rather than being stored in local data storage. The look-up table may in certain embodiments be periodically updated to reflect learned changes in the relationships between the engine speed and the hydraulic oil temperature. In other embodiments, different relationships and associated look-up tables may be appropriate for different work vehicles, work applications, operating conditions, or the like.

The method 120 begins with engine startup (step 81), wherein the engine speed vs. hydraulic oil temperature map is loaded (step 121). The engine speed ramps up (step 82) to a low-idle state (i.e., 1000 erpm), and the hydraulic oil temperature begins to warm up. Operator-provided engine speed commands 56 and software commands 57 are continuously or at least periodically monitored (step 83). If an operator command for a higher engine speed is determined (step 84), the actual hydraulic oil temperature is calculated or otherwise obtained (step 85) via the hydraulic oil temperature sensor 54. If the actual hydraulic oil temperature is not above a threshold corresponding to the commanded engine speed on the data map (step 86), the engine speed is only changed to a speed corresponding to the current actual hydraulic oil temperature (step 122). For example, if a commanded engine speed of 2450 erpm is received by the controller 50, but the current hydraulic oil temperature is measured at 12° C., the current hydraulic oil temperature is less than the required 20° C. for that engine speed (see FIG. 10). Accordingly, the engine speed is only ramped up to a value correlating with the present hydraulic oil temperature, or about 1800 erpm. With subsequent changes in hydraulic oil temperature, the engine speed may be increased in corresponding fashion and in view of the data map, until such time as the actual hydraulic oil temperature exceeds the threshold (e.g., 20° C.) for the commanded engine speed of 2450 erpm, wherein the method proceeds to step 88 and increases the actual engine speed to the commanded value of 2450 erpm.

Figure 14:
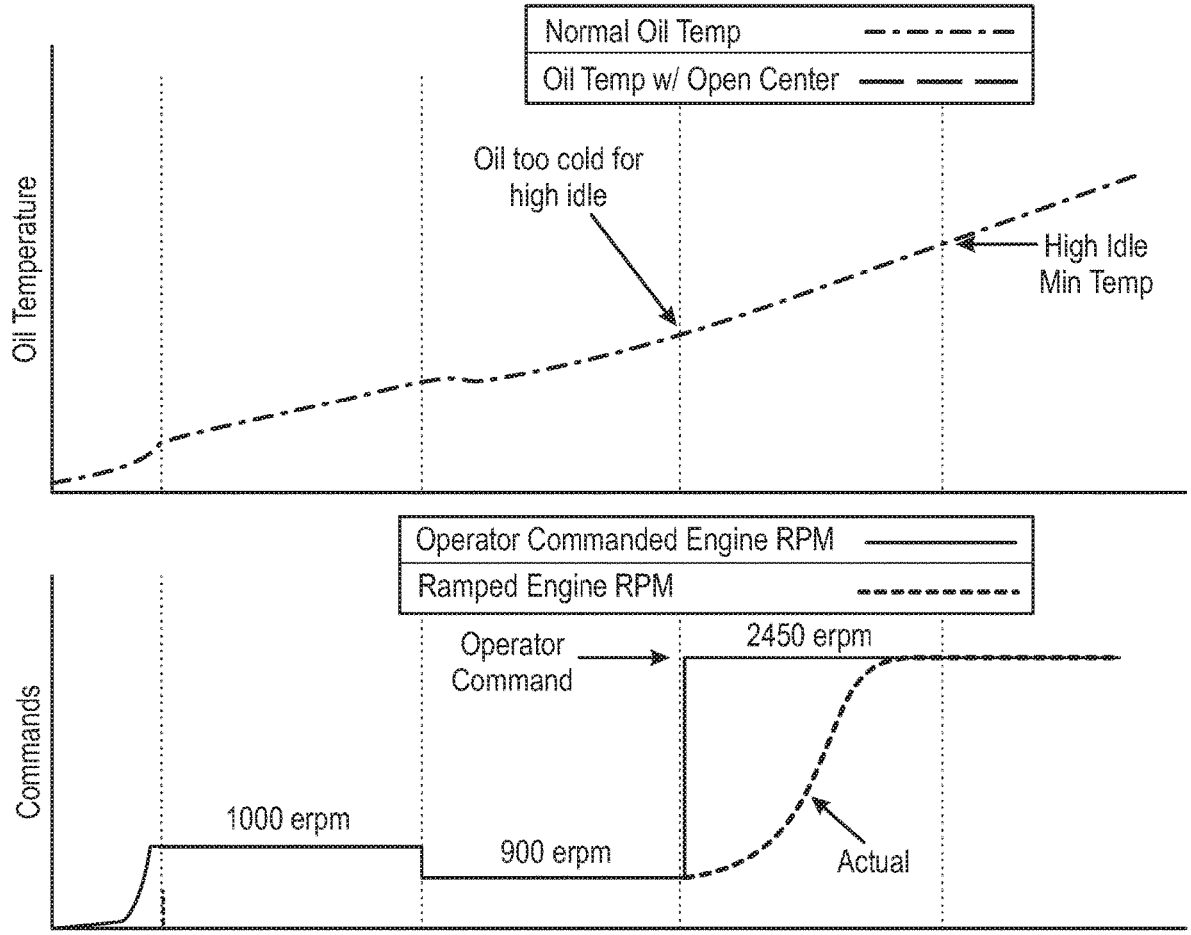
FIG. 14 is a graphical diagram representing targeted and actual engine speeds during an exemplary warmup operation in cold startup.

As shown in FIG. 14, an exemplary embodiment of this method may produce an actual engine speed which does not wait at 900 erpm until the measured hydraulic oil temperature is sufficient for operation at the commanded engine speed of 2450 erpm, but rather ramps from 900 erpm to the commanded engine speed of 2450 erpm along a curve of engine speeds correlating with the increases in hydraulic oil temperature as the oil warms up over time.

Referring next to FIG. 12, it may again be noted that for each engine speed state we prefer to minimize the amount of flow across the bypass valve to prevent contamination in the charge system. As shown in the first portion of the diagram, at 0° C. some unfiltered bypass flow will result even at low-idle operating states. As shown in the second portion of the diagram, the bypass flow at mid-idle operation is marginally acceptable at 10° C. but 15° C. is preferred. The methods disclosed herein may be implemented to prevent the engine speed from ramping to mid-idle states until after the hydraulic oil temperature is at least 10° C., but unfortunately it could take up to five minutes (or longer, depending on the vehicle and application) to reach this temperature.

As further shown in the third portion of the diagram, the oil temperature may preferably be at 20° C. or greater to provide acceptable bypass flow at high-idle operations. The methods disclosed herein may be implemented to prevent the engine speed from ramping to high-idle operation for hydraulic oil temperatures less than a threshold value such as 20° C., but unfortunately it could take an additional two minutes to reach this temperature in a mid-idle state or an additional seven minutes (or longer, depending on the vehicle and application) to reach this temperature at low idle.

Figure 13:
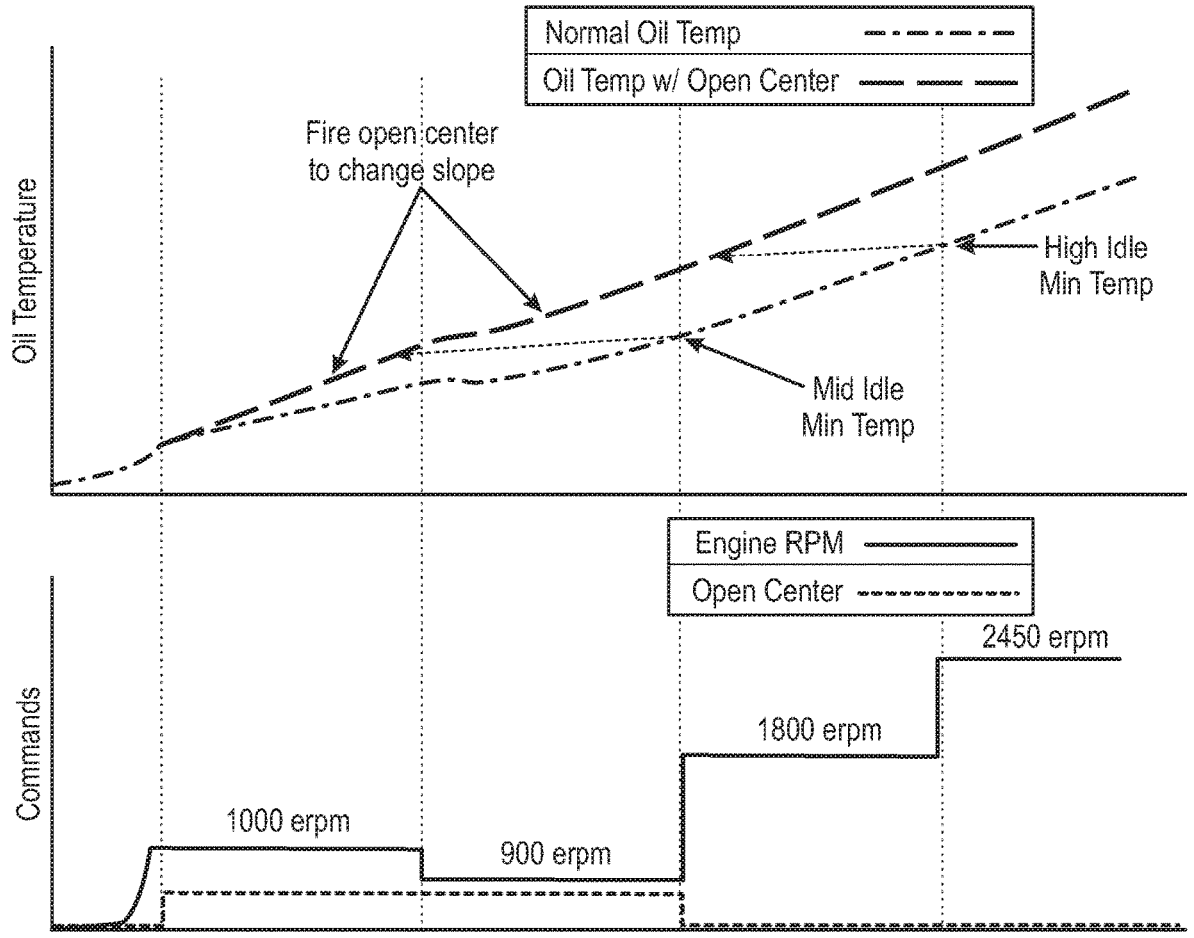
FIG. 13 is a graphical diagram representing various oil temperature curves during a cold startup based on respective exemplary warmup operations.

Referring next to FIG. 13, with a variation on the preceding methods these times may conceivably be reduced, or even at the same times at least the risks of damage may be reduced by increasing the warm-up slope of the hydraulic oil temperature, by user-selectively or automatically commanding an auxiliary hydraulic function responsive to the low-idle state initially being achieved. As illustrated in FIG. 13, the warm-up slope of the hydraulic oil temperature at the low-idle engine speeds (in this case, 1000 erpm and 900 erpm) with the open-center valve fired is greater than the warm-up slope of the hydraulic oil temperature would be otherwise, wherein the mid-idle and high-idle operating states may be achieved earlier, or these operating states may be achieved at the same time but with a higher oil temperature than would otherwise be the case, such that for example the thresholds relevant to normal operation may be loosened somewhat without incurring heightened risks of damage.

As previously noted, implementation of systems and methods as disclosed herein may yield various benefits such as making possible the replacement of high-cost components that would otherwise be necessary. Such hydraulic design opportunities may for example include the optional implementation of a charge pump with lower pressure ratings, at lower cost and yet with a longer expected life. As another example, a cold start bypass valve having an associated biasing spring rated for 300 pounds per square inch (psi) may be replaced with one having an associated biasing spring rated much lower, such as 150 psi. Depending on the application, the cold start bypass valve may even be removed altogether, a potentially desirable outcome in that it limits the charge pressure seen at the charge pump(s). These advantages are meant as illustrative and non-limiting, and other advantages or opportunities may be recognized as well by one of skill in the art.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item Band item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A control system for a self-propelled work vehicle comprising a hydraulic motor and one or more hydraulic pumps, the control system comprising:

an engine speed sensor associated with the self-propelled work vehicle and configured to generate signals representing an actual engine speed;

a temperature sensor associated with the self-propelled work vehicle and configured to generate signals representing an actual temperature of hydraulic fluid; and a controller functionally linked to receive the respective signals from the engine speed sensor and the temperature sensor, wherein the controller is configured, responsive to a requested change in engine speed, to generate output signals preventing an increase in the engine speed to a target engine speed at least while the temperature of the hydraulic fluid is in a first temperature state below a first temperature threshold.

2. The control system of claim 1, wherein the controller is further linked to a user interface to receive user input corresponding to the target engine speed.

3. The control system of claim 2, wherein the controller is further configured to cause a display unit associated with the user interface to display information corresponding to an appropriate temperature state for the target engine speed.

4. The control system of claim 1, wherein the controller is further configured to automatically generate output signals for transitioning increases in the engine speed to the target engine speed, in accordance with a monitored temperature of the hydraulic fluid and one or more corresponding temperature states.

5. The control system of claim 4, wherein the transitioning of the engine speed to the target engine speed is accomplished in steps as the monitored temperature exceeds respective thresholds for the one or more corresponding temperature states.

6. The control system of claim 4, wherein the controller is further configured to automatically generate output signals for continuously transitioning the engine speed to the target engine speed, based on a determined relationship between the engine speed and a monitored temperature of the hydraulic fluid.

7. The control system of claim 6, further comprising a data storage unit functionally linked to the controller, the data storage unit comprising a look-up table correlating retrievable engine speed data with inputs for the monitored temperature of the hydraulic fluid.

8. The control system of claim 1, wherein a second temperature state corresponds to a second engine speed for temperatures below a second temperature threshold and above the first temperature threshold.

9. The control system of claim 8, wherein a third temperature state corresponds to the target engine speed.

10. A method of engine speed control for a self-propelled work vehicle comprising an engine, one or more hydraulic motors, and one or more hydraulic pumps, the method comprising:

detecting an engine speed and a temperature of hydraulic fluid;

responsive to a requested change in engine speed, preventing an increase in the engine speed to a target engine speed at least while the temperature of the hydraulic fluid is in a first temperature state below a first temperature threshold.

11. The method of claim 10, further comprising enabling user input corresponding to the target engine speed via a user interface.

12. The method of claim 10, further comprising displaying information corresponding to an appropriate temperature state for the target engine speed.

13. The method of claim 10, further comprising automatically transitioning increases in the engine speed to the target engine speed, in accordance with a monitored temperature of the hydraulic fluid and one or more corresponding temperature states.

14. The method of claim 13, wherein the transitioning of the engine speed to the target engine speed is accomplished in steps as the monitored temperature exceeds respective thresholds for the one or more corresponding temperature states.

15. The method of claim 13, further comprising continuously transitioning the engine speed to the target engine speed, based on a determined relationship between the engine speed and a monitored temperature of the hydraulic fluid.

16. The method of claim 10, wherein a second temperature state corresponds to a second engine speed for temperatures below a second temperature threshold and above the first temperature threshold.

17. The method of claim 16, wherein a third temperature state corresponds to the target engine speed.

18. The method of claim 16, wherein the second temperature state corresponds to the second engine speed for temperatures below 20 degrees Celsius.

* * * * *